US008705995B2

(12) United States Patent
Maeda et al.

(10) Patent No.: US 8,705,995 B2
(45) Date of Patent: Apr. 22, 2014

(54) IMAGE FORMING APPARATUS

(75) Inventors: Shouichi Maeda, Kanagawa (JP); Junichi Asaoka, Kanagawa (JP); Yoshinori Koike, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 230 days.

(21) Appl. No.: 13/105,597

(22) Filed: May 11, 2011

(65) Prior Publication Data

US 2012/0114342 A1 May 10, 2012

(30) Foreign Application Priority Data

Nov. 9, 2010 (JP) ..... 2010-250730

(51) Int. Cl.
*G03G 15/00* (2006.01)

(52) U.S. Cl.
USPC ..... 399/68; 399/21

(58) Field of Classification Search
USPC ..... 399/9, 21, 67–70, 361, 386, 381
See application file for complete search history.

(56) References Cited

U.S. PATENT DOCUMENTS

| | | | | |
|---|---|---|---|---|
| 4,540,274 | A * | 9/1985 | Abuyama | 399/70 |
| 7,496,300 | B2 * | 2/2009 | Dan | 399/21 |
| 2005/0191068 | A1 * | 9/2005 | Sato | 399/38 |
| 2009/0317103 | A1 * | 12/2009 | Furukawa et al. | 399/49 |

FOREIGN PATENT DOCUMENTS

| | | | | |
|---|---|---|---|---|
| JP | 58044475 | A * | 3/1983 | G03G 15/00 |
| JP | 60095447 | A * | 5/1985 | G03G 15/00 |
| JP | 3-62080 | A | 3/1991 | |
| JP | 08286586 | A * | 11/1996 | G03G 21/14 |

* cited by examiner

*Primary Examiner* — Nguyen Ha
(74) *Attorney, Agent, or Firm* — Sughrue Mion, PLLC

(57) ABSTRACT

An image forming apparatus includes a transporting section including a transport path for transporting a recording medium; an image forming unit that forms an image on the recording medium that is transported at the transporting section; a fixing device that fixes the image formed on the recording medium at the image forming unit while heating the image; and a controller that performs control so that Pw<Pw1+Pw2 is set and so that a forced transporting operation of the transporting section is performed before starting or after ending a preparation operation of the fixing device, where Pw1 is electric power for the preparation operation including increasing a temperature of the fixing device, Pw2 is electric power for the forced transporting operation of forcedly transporting the recording medium jammed in the transporting section, and Pw is a specified value of electric power consumption.

14 Claims, 7 Drawing Sheets

IMAGE FORMING APPARATUS

CROSS-REFERENCE TO RELATED APPLICATIONS

This application is based on and claims priority under 35 USC 119 from Japanese Patent Application No. 2010-250730 filed Nov. 9, 2010.

BACKGROUND

(i) Technical Field

The present invention relates to an image forming apparatus.

SUMMARY

According to an aspect of the invention, there is provided an image forming apparatus including a transporting section including a transport path for transporting a recording medium; an image forming unit that forms an image on the recording medium that is transported at the transporting section; a fixing device that fixes the image formed on the recording medium at the image forming unit while heating the image formed on the recording medium; and a controller that performs control so that Pw<Pw1+Pw2 is set and so that a forced transporting operation of the transporting section is performed before starting or after ending a preparation operation of the fixing device, where Pw1 is electric power for the preparation operation including increasing a temperature of the fixing device, Pw2 is electric power for the forced transporting operation of forcedly transporting the recording medium that is jammed in the transporting section, and Pw is a specified value of electric power consumption.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will be described.

Figure 1:
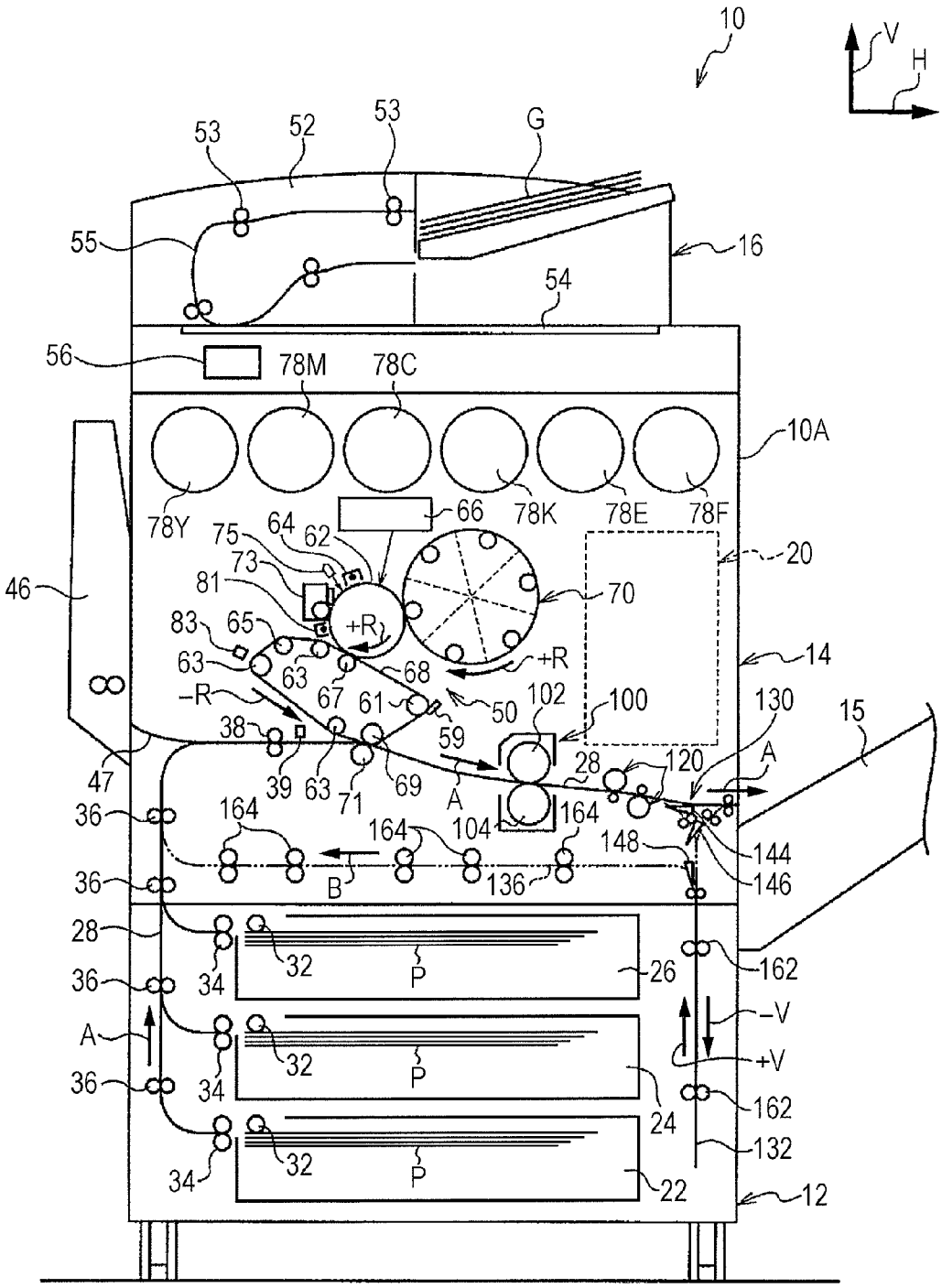
FIG. 1 shows the entire structure of an image forming apparatus according to an exemplary embodiment of the present invention.

FIG. 1 shows an image forming apparatus 10. The image forming apparatus 10 includes a sheet holding unit 12, a body 14, an original reading unit 16, and a controller 20, from a lower side to an upper side in a vertical direction (that is, in the direction of arrow V). The sheet holding unit 12 holds sheets of recording paper P serving as exemplary recording media. The body 14 is provided above the sheet holding unit 12, and performs image formation on the sheets of recording paper P supplied from the sheet holding unit 12. The original reading unit 16 is provided above the body 14, and reads reading originals G. The controller 20 is provided in the body 14, and serves as an exemplary controller that controls the operation of each portion of the image forming apparatus 10. In the description below, the vertical direction of an apparatus body 10A of the image forming apparatus 10 corresponds to the direction V, and the horizontal direction thereof corresponds to a direction H.

The sheet holding unit 12 includes a first holding section 22, a second holding section 24, and a third holding section 26, which hold sheets of recording paper P of different sizes. The first holding section 22, the second holding section 24, and the third holding section 26 are each provided with a sending roller 32 that sends the held sheets of recording paper P to a transport path 28 provided in the image forming apparatus 10. Pairs of transporting rollers 34 and pairs of transporting rollers 36 serving as exemplary pairs of transporting sections that transport the sheets of recording paper P one at a time are disposed downstream from the respective sending rollers 32 in the transport path 28. Adjustment rollers 38 serving as exemplary transporting sections are provided downstream from the transporting rollers 36 in a direction of transportation of the sheets of recording paper P in the transport path 28. The adjustment rollers 38 stop the sheets of recording paper P once, and send them to a second transfer position QB (described later; see FIG. 2) at a determined timing.

An upstream side portion of the transport path 28 is provided linearly from a lower left portion of the sheet holding unit 12 to a lower left portion of the body 14 in the direction V in front view of the image forming apparatus 10. A downstream side portion of the transport path 28 is provided from the lower left portion of the body 14 to a discharge unit 15 provided at the right surface of the body 14. A two-side transport path 136 is connected to the transport path 28, and allows the sheets of recording paper P to be transported and reversed for forming images on both surfaces of the sheets of recording paper P. A folding-type manual sheet feeding unit 46 is provided at the left surface of the body 14. A transport path 47 of the sheets of recording paper P that are sent from the manual sheet feeding unit 46 is connected to a near side of the adjustment rollers 38 in the transport path 28. The switching between transport paths of the sheets of recording paper P will be described in detail below.

The original reading unit 16 includes a document transport device 52, a platen glass 54, and a document reading device 56. The document transport device 52 automatically transports the reading originals G one at a time. The platen glass 54 is disposed at the lower side of the document transport device 52. One reading original G is placed upon the platen glass 54. The document reading device 56 reads the reading original G transported by the document transport device 52 or the reading original G placed on the platen glass 54.

The document transport device 52 includes an automatic transport path 55 in which pairs of transporting rollers 53 are disposed. A portion of the automatic transport path 55 is disposed so that the reading original G passes the upper side of the platen glass 54. The document reading device 56 reads the reading original G transported by the document transport device 52 while it is stationary at a left end of the platen glass 54, or reads the reading original G placed on the platen glass 54 while it moves in the direction H.

The body 14 includes an image forming unit 50 serving as an exemplary image forming unit that forms a toner image (developer image) on the recording paper P. The image forming unit 50 includes a photoconductor member 62, a charging member 64, an exposure device 66, a developing device 70, an intermediate transfer belt 68, and a cleaning device 73 (described later).

The cylindrical photoconductor member 62, serving as an image carrying member, is provided at a central portion of the apparatus body 10A in the body 14. The photoconductor member 62 is rotated in a direction of arrow +R (clockwise in FIG. 2) by a driving unit (not shown), and carries at its outer peripheral surface an electrostatic latent image formed by light irradiation. The corotron charging member 64 that charges the surface of the photoconductor member 62 is provided above the photoconductor member 62 and opposes the outer peripheral surface of the photoconductor member 62.

The exposure device 66 is provided downstream from the charging member 64 in the direction of rotation of the photoconductor member 62, and opposes the outer peripheral surface of the photoconductor member 62. The exposure device 66 includes a semiconductor laser, a f-θ lens, a polygon mirror, an imaging lens, and mirrors (none of which are shown). On the basis of an image signal, laser light emitted from the semiconductor laser is deflected by the polygon mirror for performing scanning, and illuminates (is used for exposing) the outer peripheral surface of the photoconductor member 62 that is charged by the charging member 64, to form an electrostatic latent image. The exposure device 66 is not limited to a type in which the laser light is deflected by the polygon mirror for performing scanning. The exposure device 66 may be a type using a light emitting diode (LED).

The developing device 70 is provided downstream from a member that is irradiated with the exposure light of the exposure device 66 in the direction of rotation of the photoconductor member 62. The developing device 70 is a rotational switching type that develops the electrostatic latent image (formed on the outer peripheral surface of the photoconductor member 62) with toner of a determined color, to make visible the electrostatic latent image. Toner cartridges 78Y, 78M, 78C, 78K, 78E, and 78F are replaceably provided side by side in the direction H below the document reading device 56 and above the developing device 70. The toner cartridges 78Y, 78M, 78C, 78K, 78E, and 78F contain yellow (Y) toner, magenta (M) toner, cyan (C) toner, black (K) toner, a first special color (E) toner, and a second special color (F) toner, respectively. The first special color E and the second special color F are selected or are not selected from special colors (including transparent colors) which are not yellow, magenta, cyan, and black.

Figure 2:
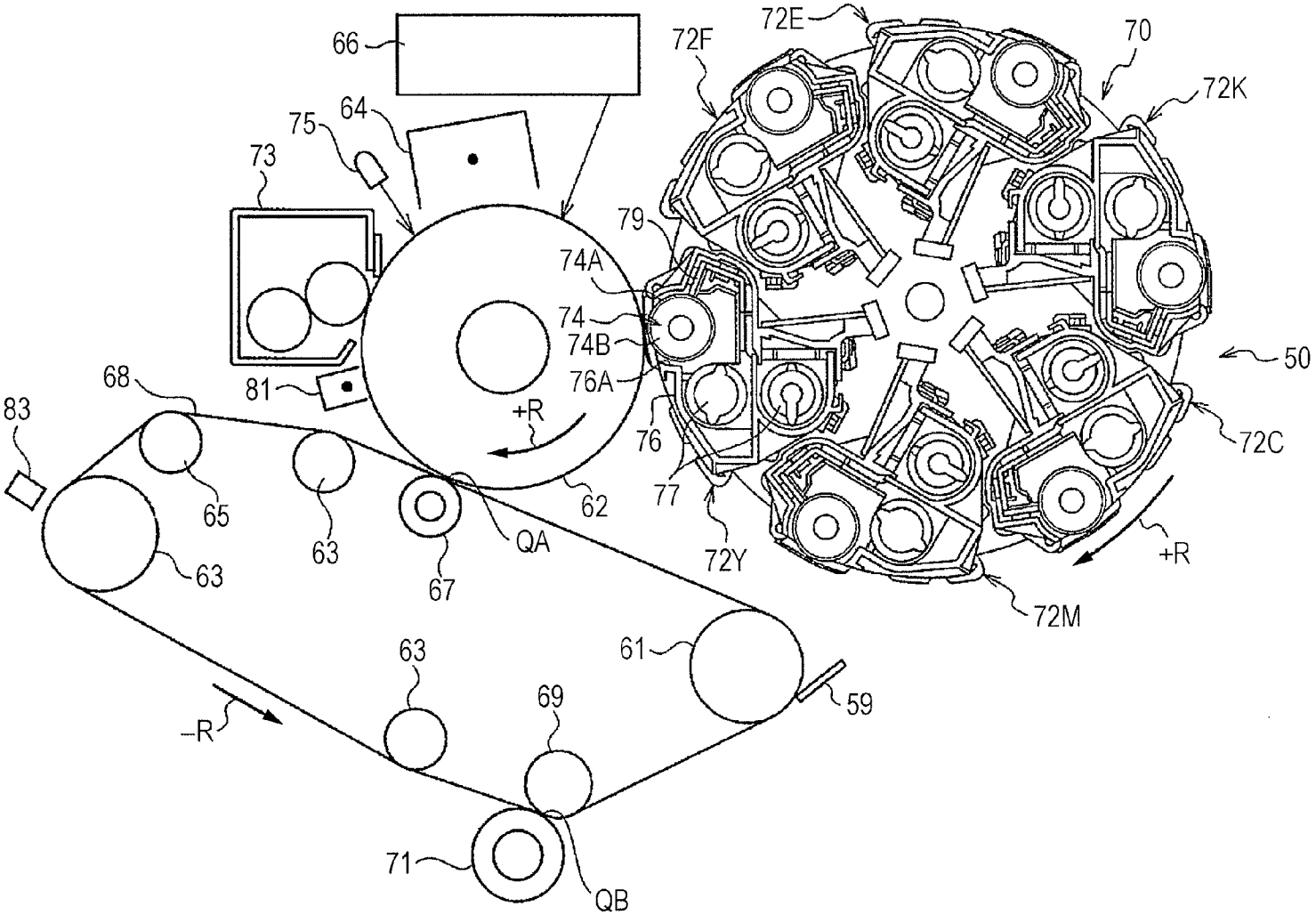
FIG. 2 shows the structure of an image forming unit according to the exemplary embodiment of the present invention.

As shown in FIG. 2, in the developing device 70, developing units 72Y, 72M, 72C, 72K, 72E, and 72F are disposed side by side in that order in a peripheral direction (that is, counterclockwise in FIG. 2) in correspondence with the toner colors, yellow (Y), magenta (M), cyan (C), black (K), the first special color (E), and the second special color (F). By rotating the developing device 70 by a motor (not shown) by a central angle of 60 degrees at a time, the developing unit 72Y, 72M, 72C, 72K, 72E, or 72F that performs a developing operation is switched, and the developing unit to perform a developing operation opposes the outer peripheral surface of the photoconductor member 62.

Since the developing units 72Y, 72M, 72C, 72K, 72E, and 72F have the same structures, here, the developing unit 72Y will be described, and the other developing units 72M, 72C, 72K, 72E, and 72F will not be described. When image formation using four colors, Y, M, C, and K, is performed, the developing units 72E and 72F are not used. Therefore, the angle of rotation from the developing unit 72K to the developing unit 72Y is 180 degrees.

The developing unit 72Y includes a case member 76 serving as a body. The case member 76 is filled with developer, formed of a carrier and toner, supplied from the toner cartridge 78Y (see FIG. 1) through a toner supply path (not shown). The case member 76 has a rectangular opening 76A opposing the outer peripheral surface of the photoconductor member 62. A development roller 74 whose outer peripheral surface opposes the outer peripheral surface of the photoconductor member 62 is provided in the opening 76A. Further, a plate-like regulating member 79 for regulating a layer thickness of the developer is provided near the opening 76A in the case member 76 so as to extend in a longitudinal direction of the opening 76A.

The development roller 74 has a rotatably provided cylindrical development sleeve 74A and a magnetic member 74B including magnetic poles fixed to the inner side of the development sleeve 74A. By rotating the development sleeve 74A, a magnetic brush of the developer (carrier) is formed. By regulating the layer thickness by the regulating member 79, a developer layer is formed on the outer peripheral surface of the development sleeve 74A. Then, the developer layer on the outer peripheral surface of the development sleeve 74A is transported to a position opposing the photoconductor member 62 by rotating the development sleeve 74A, so that toner that is in accordance with the latent image (electrostatic latent image) formed on the outer peripheral surface of the photoconductor member 62 is adhered to the latent image, to develop the latent image.

In the case member 76, two spiral transporting rollers 77 are rotatably disposed beside each other. By rotating the two transporting rollers 77, the developer with which the case member 76 is filled is circulated and transported in an axial direction of the development roller 74 (that is, in a longitudinal direction of the developing unit 72Y). The six development rollers 74 of the developing units 72Y, 72M, 72C, 72K, 72E, and 72F are disposed in the peripheral direction with the size of the interval between adjacent development rollers 74 being equal to a central angle of 60 degrees. By switching a certain developing unit 72, the next developing roller 74 is made to oppose the outer peripheral surface of the photoconductor member 62.

As shown in FIG. 1, the intermediate transfer belt 68 is provided downstream from the developing device 70 in the direction of rotation of the photoconductor member 62, and is provided below the photoconductor member 62. Toner images that are formed on the outer peripheral surface of the photoconductor member 62 are transferred to the intermediate transfer belt 68. The intermediate transfer belt 68 is an endless belt, and is placed around a driving roller 61, a tension applying roller 65, transporting rollers 63, and an auxiliary roller 69. The driving roller 61 is rotationally driven by the controller 20. The tension applying roller 65 applies tension to the intermediate transfer belt 68. The transporting rollers 63 contact the inner side of the intermediate transfer belt 68, and are driven and rotated. The auxiliary roller 69 contacts the inner side of the intermediate transfer belt 68 at the second transfer position QB (described later; see FIG. 2), and is driven and rotated. By rotating the driving roller 61, the intermediate transfer belt 68 rotates in the direction of arrow −R (that is, counterclockwise in FIG. 2).

A first transfer roller 67 is provided opposite to the photoconductor member 62 with the intermediate transfer belt 68 being interposed therebetween. The first transfer roller 67 causes the toner images formed on the outer peripheral surface of the photoconductor member 62 to be transferred to the intermediate transfer belt 68 by a first transfer operation. The first transfer roller 67 is in contact with the inner side of the intermediate transfer belt 68 at a position where the photoconductor member 62 and the intermediate transfer belt 68 contact each other (this position is called "first transfer position QA" (see FIG. 2)). By applying electric power from a power source (not shown), the first transfer roller 67 causes the toner images carried by the outer peripheral surface of the photoconductor member 62 to be transferred to the intermediate transfer belt 68 by the first transfer operation due to a potential difference between the photoconductor member 62 that is connected to ground and the first transfer roller 67.

A second transfer roller 71 is provided opposite to the auxiliary roller 69 with the intermediate transfer belt 68 being disposed therebetween. The second transfer roller 71 causes the toner images transferred to the intermediate transfer belt 68 by the first transfer operation to be transferred to recording paper P by a second transfer operation. The position between the second transfer roller 71 and the auxiliary roller 69 corresponds to the second transfer position QB where the toner images are transferred to the recording paper P (see FIG. 2). The second transfer roller 71 is connected to ground, and is in contact with the surface (outer peripheral surface) of the intermediate transfer belt 68. By a potential difference between the second transfer roller 71 and the auxiliary roller 69 to which electric power is applied from a power source (not shown), the toner images on the intermediate transfer belt 68 are transferred to the recording paper P by the second transfer operation.

A cleaning blade 59 that collects residual toner after the second transfer operation at the intermediate transfer belt 68 is provided at a side opposite to the driving roller 61 with the intermediate transfer belt 68 being disposed therebetween. The cleaning blade 59 is mounted to a housing (not shown) having an opening. Any toner that is scraped off by an end of the cleaning blade 59 is collected in the housing.

A position detecting sensor 83 is provided at a position opposing the transporting roller 63 near the intermediate transfer belt 68. The position detecting sensor 83 detects a predetermined reference position on the intermediate transfer belt 68 by detecting a mark (not shown) on the outer surface of the intermediate transfer belt 68, and outputs a position detection signal serving as a reference of timing for starting the image formation. The position detecting sensor 83 detects a movement position of the intermediate transfer belt 68 by irradiating the intermediate transfer belt 68 with light and receiving the light reflected from the surface of the mark.

The cleaning device 73 is provided downstream from the first transfer roller 67 in the direction of rotation of the photoconductor member 62. The cleaning device 73 cleans off, for example, any residual toner that is not transferred by the first transfer operation to the intermediate transfer belt 68 and that remains on the surface of the photoconductor member 62. The cleaning device 73 collects, for example, any residual toner by a cleaning blade and a brush roller that are in contact with the outer peripheral surface of the photoconductor member 62.

A corotron 81 is provided upstream from the cleaning device 73 (that is, downstream from the first transfer roller 67) in the direction of rotation of the photoconductor member 62. The corotron 81 removes electricity of the residual toner remaining after the first transfer operation on the outer peripheral surface of the photoconductor member 62. An electricity removing device 75 that removes electricity by irradiating the outer peripheral surface of the cleaned photoconductor member 62 with light is provided downstream from the cleaning device 73 (upstream from the charging member 64) in the direction of rotation of the photoconductor member 62.

The second transfer position QB of the toner images defined by the second transfer roller 71 (see FIG. 2) is set in the transport path 28. A first sheet sensor 39 is provided between the second transfer position QB and the adjustment rollers 38 so as to be situated above the transport path 28 and near the adjustment rollers 38. The first sheet sensor 39 detects a front end position (that is, a downstream side end portion) and a rear end position (that is, an upstream side end portion) of recording paper P. For the first sheet sensor 39, for example, a reflecting optical sensor that irradiates the recording paper P with light and that receives the light reflected from the recording paper P may be used. A fixing device 100 is provided downstream from the second transfer roller 71 in the direction of transportation of the recording paper P (that is, in the direction of arrow A in FIG. 1) at the transport path 28. The fixing device 100 is an exemplary fixing device that fixes the toner images to the recording paper P to which the toner images are transferred by the second transfer roller 71.

Figure 3:
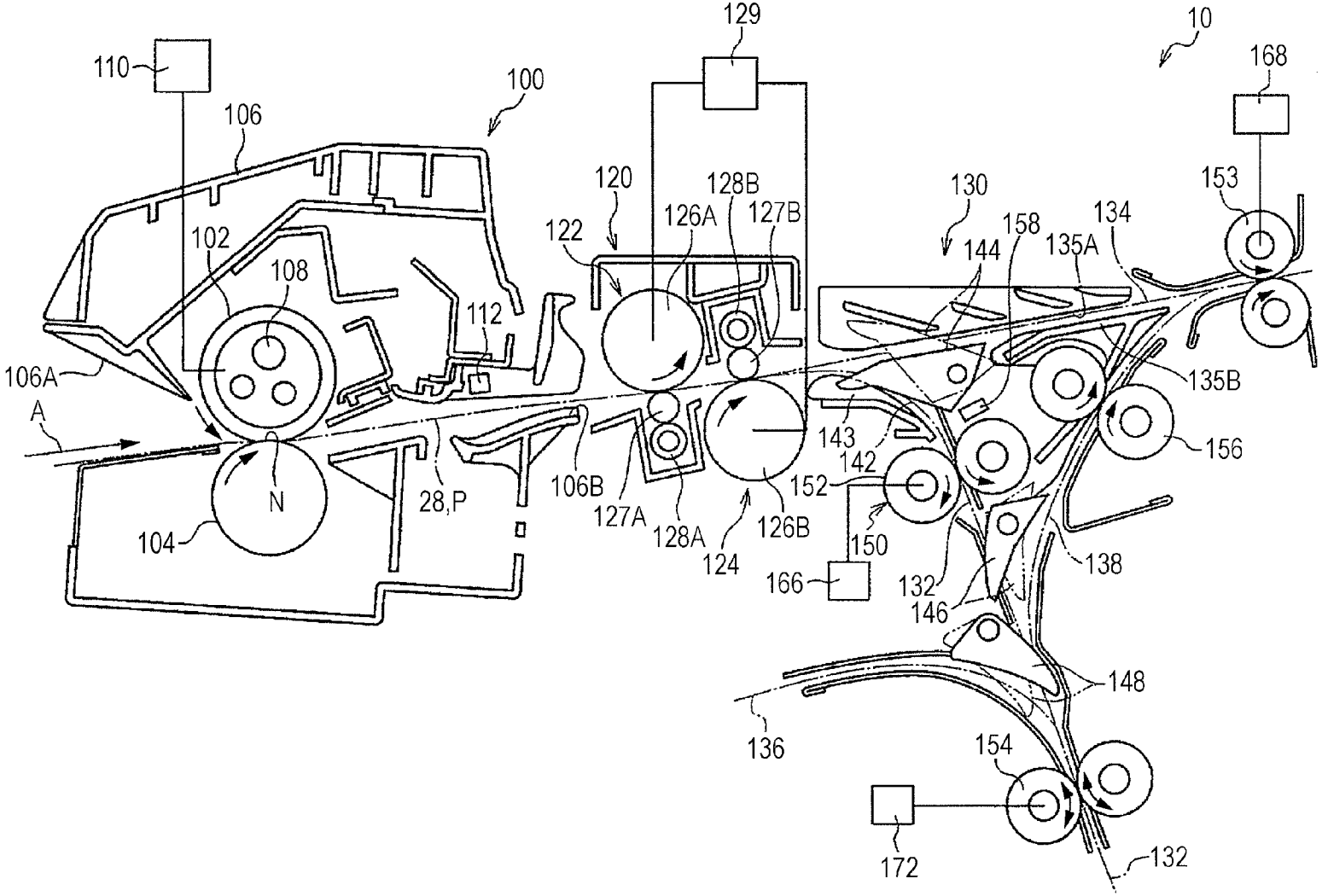
FIG. 3 shows the structure of a recording-paper transport path extending from a fixing device to a switching unit according to the exemplary embodiment of the present invention.

As shown in FIG. 3, the fixing device 100 includes a housing 106 having an opening 106A and an opening 106B. The recording paper P enters the opening 106A. The recording paper P is discharged from the opening 106B. A fixing roller 102 and a pressure roller 104 are provided as principal portions in the housing 106. The fixing roller 102 performs fixing by heating. The pressure roller 104 presses the recording paper P towards the fixing roller 102. Although the fixing device 100 is provided with, for example, temperature sensors that detect the temperatures of the pressure roller 104, the fixing roller 102, and an external heating roller that heats the fixing roller 102, these are not illustrated.

The fixing roller 102 is disposed at a toner image side (upper side) above the transport path 28 of the recording paper P. A rotary shaft of the fixing roller 102 is disposed so as to be orthogonal to the direction of transportation of the recording paper P. In an exemplary structure of the fixing roller 102, an elastic material, such as silicon rubber, covers the outer periphery of a cylindrical core formed of aluminum (not shown). A parting layer formed of fluorocarbon resin is formed around the outer peripheral surface of the elastic material.

A halogen heater 108 is provided within the core of the fixing roller 102. The halogen heater 108 serves as a heat source that is not in contact with the inner peripheral surface of the core. The halogen heater 108 is heated by heat generated by application of electric power from a power source (not shown), to heat the core, so that the entire fixing roller 102 is heated. A first motor 110 that is capable of changing the peripheral velocity of the fixing roller 102 is connected to an end of the core of the fixing roller 102 through a gear (not shown). The first motor 110 is driven on the basis of a command signal sent from the controller 20 to rotationally drive the fixing roller 102.

The pressure roller 104 is disposed below the fixing roller 102 at the transport path of recording paper P. By a biasing force, such as that of a spring (not shown), the pressure roller 104 contacts and presses the outer peripheral surface of the fixing roller 102, so that a contact area (that is, a nip part N) is formed between the fixing roller 102 and the pressure roller 104. In an exemplary structure of the pressure roller 104, an elastic material, such as silicon rubber, covers the outer periphery of a cylindrical core formed of aluminum. A parting layer formed of fluorocarbon resin is formed around the outer peripheral surface of the elastic material. The pressure roller 104 is rotated by being driven by the rotation of the fixing roller 102. A halogen heater, serving as a heat source, may be provided within the core to heat the pressure roller 104.

A second sheet sensor 112 is provided above the transport path 28 in the fixing device 100. The second sheet sensor 112 detects a front end position in the transportation direction of recording paper P and a rear end position in the transportation direction of recording paper P. For the second sheet sensor 112, for example, a reflecting optical sensor that irradiates the recording paper P with light and that receives the light reflected from the recording paper P may be used. The second sheet sensor 112 is mounted at a position that is downstream from the nip part N in the direction of transportation of the recording paper P (that is, in the direction of arrow A) and that is upstream from the opening 106B in the direction of transportation of the recording paper P.

Next, the transport path 28 and the two-side transport path 136 will be described in detail.

As shown in FIG. 3, a decurl unit 120 is provided downstream from the fixing device 100 in the direction of transportation of recording paper P at the transport path 28. The decurl unit 120 straightens in the opposite direction a curl of the recording paper P after the fixing by the fixing device 100. The straightening of the curl of the recording paper P by the decurl unit 120 is performed regardless of switching between the transport paths of the recording paper P.

The decurl unit 120 includes a first decurl section 122 and a second decurl section 124. The first decurl section 122 serves as an exemplary transporting section and is disposed at an upstream side in the direction of transportation of recording paper P. The second decurl section 124 serves as an exemplary transporting section and is disposed at a downstream side in the direction of transportation of recording paper P. The first decurl section 122 includes a decurl roller 126A, a metallic roller 127A, and a bearing 128A. The decurl roller 126A is a sponge roller disposed at the upper side of the transport path 128. The metallic roller 127A is disposed at the lower side of the transport path 28 and contacts the outer peripheral surface of the decurl roller 126A. The bearing 128A contacts the outer peripheral surface of the metallic roller 127A at a side opposite to the decurl roller 126A, and reduces flexing of the metallic roller 127A. The outside diameter of the decurl roller 126A is larger than the outside diameter of the metallic roller 127A.

The second decurl section 124 includes a decurl roller 126B, a metallic roller 127B, and a bearing 128B. The decurl roller 126B is a sponge roller disposed at the lower side of the transport path 128. The metallic roller 127B is disposed at the upper side of the transport path 28 and contacts the outer peripheral surface of the decurl roller 126B. The bearing 128B contacts the outer peripheral surface of the metallic roller 127B at a side opposite to the decurl roller 126B, and reduces flexing of the metallic roller 127B. The outside diameter of the decurl roller 126B is larger than the outside diameter of the metallic roller 127B.

The decurl roller 126A and the decurl roller 126B, the metallic roller 127A and the metallic roller 127B, and the bearing 128A and the bearing 128B are formed of the same material and have the same shape. Directions of rotation axes of the decurl roller 126A, the decurl roller 126B, the metallic roller 127A, the metallic roller 127B, the bearing 128A, and the bearing 128B are orthogonal to the direction of transportation of recording paper P.

One second motor 129 is connected to end portions of the cores (not shown) of the decurl rollers 126A and 126B through gears (not shown). The second motor 129 is driven on the basis of a command signal sent from the controller 20 to rotationally drive the decurl rollers 126A and 126B. The decurl roller 126A rotates in the illustrated counterclockwise direction, whereas the decurl roller 126B rotates in the illustrated clockwise direction.

A switching unit 130 is provided downstream from the decurl unit 120 in the direction of transportation of recording paper P. The switching unit 130 switches the direction of transportation of recording paper P transported along the transport path 28. At the switching unit 130, a terminal end of the transport path 28 is divided into a reverse transport path 132 and a first discharge path 134. The reverse transport path 132 serves as an exemplary transport path and has a curved portion 142 that curves downward. The first discharge path 134 serves as an exemplary transport path and is approximately a straight path that extends towards the discharge unit 15 (see FIG. 1).

A portion of the reverse transport path 132 is divided into the two-side transport path 136 and a second discharge path 138. The two-side transport path 136 serves as an exemplary transport path and extends towards the transporting rollers 36 (see FIG. 1) for forming an image on the back of the recording paper P. The second discharge path 138 extends towards the discharge unit 15. A guide member 143 having a curved surface forming the curved portion 142 is provided at the reverse transport path 132. A guide member 135A and a guide member 135B are provided at the first discharge path 134. The guide member 135A forms an upper wall of the first discharge path 134. The guide member 135B is disposed opposite to the guide member 135A and forms a bottom wall of the first discharge path 134. For saving space in the transport path of recording paper P, the guide members 135A and 135B are disposed with a small distance therebetween, and the transport path is formed straight.

As shown in FIG. 1, the reverse transport path 132 is formed straight in the direction of arrow V (illustrated downward direction is indicated by −V, and illustrated upward direction is indicated by +V) from the lower right side of the body 14 to the lower right side of the sheet holding unit 12.

Pairs of transporting rollers 162 that serve as exemplary pairs of transporting sections and that transport recording paper P are provided at the reverse transport path 132. The two-side transport path 136 is provided from a portion of the reverse transport path 132 (a third switching member 148 (described later)) towards the transporting rollers 36 in the direction H. Pairs of transporting rollers 164 that serve as exemplary pairs of transporting sections and that transport recording paper P are provided at the two-side transport path 136. By switching an entrance path of the rear end of the recording paper P to the two-side transport path 136 by the third switching member 148 (described below), the recording paper P that has entered the reverse transport path 132 is transported in the two-side transport path 136 in the direction of arrow B (that is, leftwards in FIG. 1). A terminal end of the two-side transport path 136 is connected to a near side of the transporting rollers 36 at the transport path 28.

As shown in FIG. 3, the switching unit 130 includes a first switching member 144, a second switching member 146, and a third switching member 148. The first switching member 144 switches the transport path of recording paper P from the transport path 28 to the reverse transport path 132 or the first discharge path 134. The second switching member 146 switches between the reverse transport path 132 and the second discharge path 138. The third switching member 148 switches between the two-side transport path 136 and the second discharge path 138. The first switching member 144, the second switching member 146, and the third switching member 148 are all triangular prismatic members. When an end of a particular switching member is moved into one particular transport path by a driving unit (not shown), the transport path of recording paper P is switched to another transport path.

A reverse transporting section 150 serving as an exemplary transporting section that transports recording paper P is provided between the first switching member 144 and the second switching member 146 in the reverse transport path 132. The reverse transporting section 150 includes a pair of first transporting rollers 152 and a third motor 166. The third motor 166 has its rotation controlled by the controller 20 (see FIG. 1), and rotationally drives the first transporting rollers 152.

A pair of second transporting rollers 154 that transport recording paper P are provided downstream from (at the illustrated lower side of) the third switching member 148. The second transporting rollers 154 are rotated by a fifth motor 172 whose rotation is controlled by the controller 20. A pair of third transporting rollers 156 that transport recording paper P are provided at the second discharge path 138. The third transporting rollers 156 are also driven by a motor (not shown), but this will not be described.

A pair of discharge rollers 153 that discharge the recording paper P to the discharge unit 15 (see FIG. 1) are provided at a terminal end of the first discharge path 134. By a fourth motor 168 whose operation is controlled by the controller 20, the discharge rollers 153 rotate.

A third sheet sensor 158 is provided between the first switching member 144 and the pair of first transporting rollers 152 outside the reverse transport path 132. The third sheet sensor 158 detects a front end position and a rear end position of recording paper P that is transported in the reverse transport path 132. For the third sheet sensor 158, for example, a reflecting optical sensor that irradiates the recording paper P with light and that receives the light reflected from the recording paper P may be used.

Here, the distance from the fixing roller 102 to the first transporting rollers 152 in the transport path 28 and in the reverse transport path 132 is set smaller than the entire length of the recording paper P in the transportation direction thereof, so that a timing in which the recording paper P is nipped by both the fixing roller 102 and the first transporting rollers 152 is provided. The distance from the fixing roller 102 to the discharge rollers 153 is set smaller than the entire length of the recording paper P in the transportation direction thereof, so that a timing in which the recording paper P is nipped by both the fixing roller 102 and the discharge rollers 153 is provided.

Next, principal switching operations between the transport paths of recording paper P at the switching unit 130, and the transport paths of recording paper P will be described.

In the image forming apparatus 10 shown in FIG. 3, when performing duplex printing in which transfer (including image formation) and fixing of toner images to the front surface (that is, the illustrated upper surface) of recording paper P end, and, then, transfer (including image formation) and fixing of toner images to the back surface (that is, the illustrated lower surface) of the recording paper P are performed, the following occurs. That is, in the switching unit 130, the first switching member 144 moves to close the first discharge path 134 and to open the reverse transport path 132; and the second switching member 146 moves to close the second discharge path 138 and to open the reverse transport path 132. Further, the third switching member 148 moves to close the two-side transport path 136, and to open the reverse transport path 132. By this, after the recording paper P transported to the transport path 28 passes the decurl unit 120, it enters the reverse transport path 132.

Next, when the rear end of the recording paper P that enters the reverse transport path 132 passes the second transporting rollers 154, the third switching member 148 closes the second discharge path 138 and opens the two-side transport path 136, and the second transporting rollers 154 rotate in the reverse direction. By this, the rear end of the recording paper P is switched to the front end, the recording paper P is transported along the two-side transport path 136, and reenters the transport path 28, so that the image formation is performed on the back surface of the recording paper P.

In the image forming apparatus 10, when the image formation is performed only on the front surface of the recording paper P, and the front and back surfaces of the recording paper P are reversed to discharge the recording paper P, the following occurs. That is, the recording paper P enters the reverse transport path 132, and the rear end thereof passes the second transporting rollers 154, at which time the second switching member 146 moves to open the second discharge path 138. When the second transporting rollers 154 rotate in the reverse direction, the rear end of the recording paper P is switched to the front end, and the recording paper P is transported to the second discharge path 138 and discharged. When the image formation and fixing are performed on the front surface of the recording paper P, and the recording paper P is discharged as it is after passing the decurl unit 120, the following occurs. That is, the first switching member 144 moves to close the reverse transport path 132, and to open the first discharge path 134.

Next, the operation of eliminating sheet jamming when recording paper P is jammed in the transport paths will be described.

Figure 4:
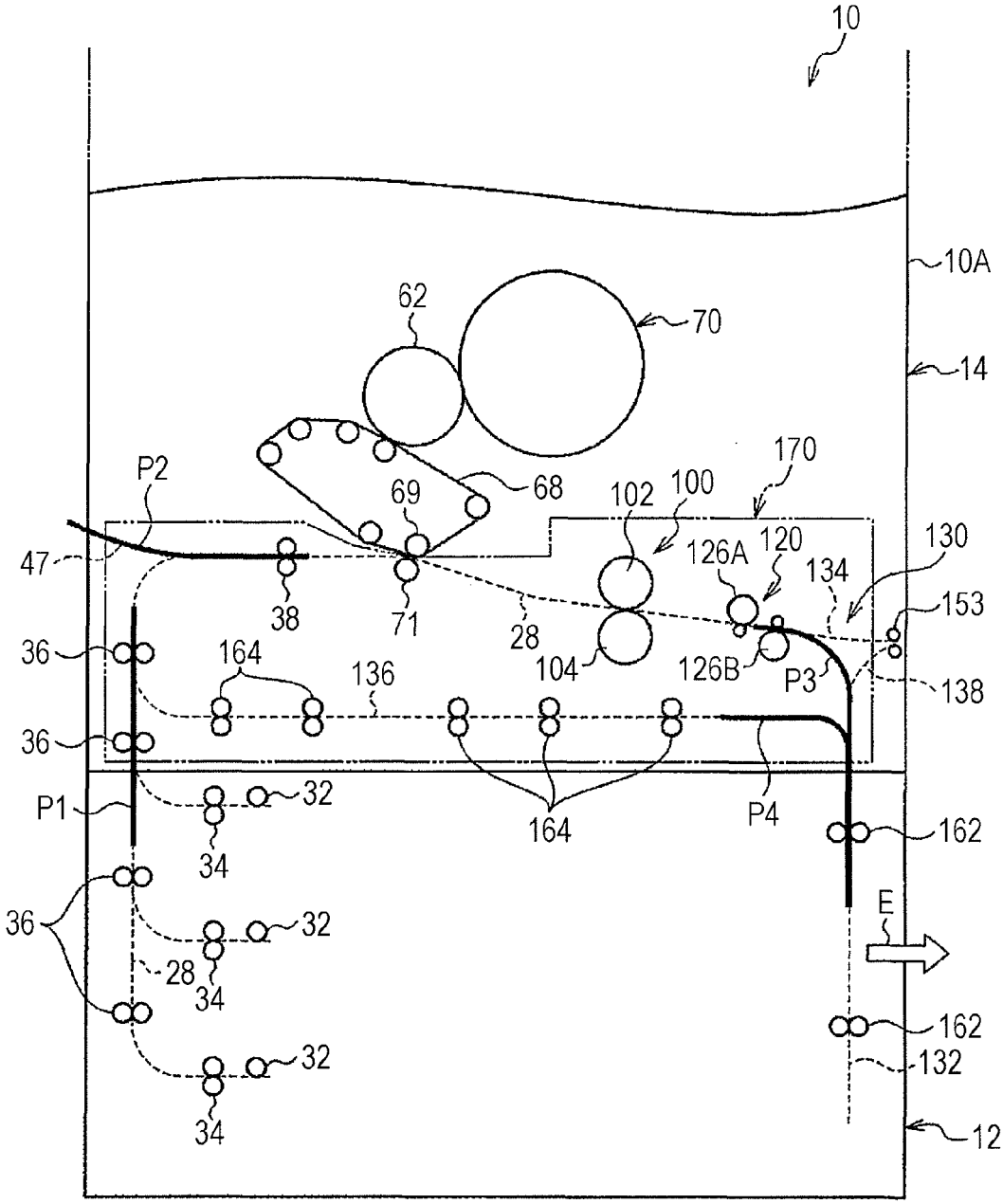
FIG. 4 is a schematic view showing a state in which recording paper is jammed in the transport path of the image forming apparatus according to the exemplary embodiment of the present invention.

In FIG. 4, states in which sheets of recording paper P (shown by solid lines) are jammed in the transport path 28, the reverse transport path 132, and the two-side transport path 136 of the image forming apparatus 10 are indicated by recording paper P1, recording paper P2, recording paper P3, and recording paper P4. The jammed states of the sheets of recording paper P1, P2, P3, and P4 do not occur at the same time. The jammed states of the sheets of recording paper P in the respective transport paths are all shown in FIG. 4 for the sake of easier understanding. At the controller 20, the positions where the sheets of recording paper P1, P2, P3, and P4 are jammed are detected using sheet detecting sensors (not shown) provided at the respective transport paths.

As shown in FIG. 4, the image forming apparatus 10 includes a drawing out unit 170 in which a range shown by an alternate long and two short dash line is capable of being drawn out towards the front (that is, the near side in the direction of the rotation axis of each roller). The drawing out unit 170 is divided at the lower side of the lowest transporting rollers 36 in the transport path 28 of the body 14, at a portion in the transport path 47, at a location between the auxiliary roller 69 and the second transfer roller 71, at a portion in the first discharge path 134 and a portion in the second discharge path 138, and the lower side of the second transporting rollers 154 (see FIG. 3) in the reverse transport path 132 of the body 14. It is possible to draw out the drawing out unit 170 towards the front from the apparatus body 10A along a guide rail (not shown).

In the transport path 28, the recording paper P1 is jammed while existing in both the sheet holding unit 12 and the body 14 and being nipped by the transporting rollers 36. In the transport path 47, the recording paper P2 is jammed while its front end is nipped by the adjustment rollers 38. In the reverse transport path 132, the recording paper P3 is jammed while its front end is nipped by the transporting rollers 162 and its rear end is nipped by the decurl roller 126B. The recording paper P4 is jammed while existing in both the reverse transport path 132 and the two-side transport path 136 and being nipped by the transporting rollers 162. The sheets of recording paper P1, P2, P3, and P4 exist on both sides of the division line (alternate long and short dash line) between the apparatus body 10A and the drawing out unit 170.

An exemplary operation of eliminating the jamming of the sheets of recording paper P1, P2, P3, and P4 is as follows. The sheets of recording paper P1, P2, and P4 are forcedly transported in the drawing out unit 170 (the range indicated by the alternate long and two short dash line) when the transporting rollers 36, the adjustment rollers 38, the transporting rollers 162, and the transporting rollers 164 are rotated using the controller 20 (see FIG. 1). By drawing out the drawing out unit 170 towards the front, the sheets of recording paper P1, P2, and P4 are taken out.

The recording paper P3 is forcedly transported to the reverse transport path 132 of the sheet holding unit 12 when the transporting rollers 162 are rotated using the controller 20. By opening an opening-closing cover member (not shown), provided at a side surface of the apparatus body 10A, the recording paper P3 is taken out (in the direction of arrow E). Accordingly, in the operation of eliminating the jamming of the sheets of recording paper P in the transport paths, the sheets of recording paper P are moved by rotating the rollers by the motors. Therefore, the consumption of electric power for performing the operation of eliminating the jamming of the recording paper P is relatively high among the electric power consumptions in the image forming apparatus 10.

Next, electric power consumptions and operations of the respective portions of the image forming apparatus 10 that are set by the controller 20 will be described.

In FIG. 1, at the controller 20, an operation of eliminating jamming of recording paper P (hereunder referred to as "forced transporting operation of recording paper P") is set so that it is performed before starting or after ending a preparation operation of the fixing device 100, with Pw<Pw1+Pw2 and Pw1>Pw2. Here, Pw1 is the electric power for the preparation operation of the fixing device 100; Pw2 is the electric power for the forced transporting operation of the recording paper P; and Pw is a specified value of electric power consumption of the entire image forming apparatus 10. In the description below, the electric power for the forced transporting operation of the recording paper P and the electric power for the preparation operation of the fixing device 100 will be described with reference to FIGS. 5A and 5B, and the electric power for operations other than these operations will be described with reference to FIGS. 6A and 6B.

Here, the term "preparation operation of the fixing device 100" refers to preparation operations that cause the fixing device 100 to be in a usable state, including, for example, an operation of increasing the temperature of the fixing roller 102 by applying electric power to the halogen heater 108 (see FIG. 3), an operation of causing the pressure roller 104 to contact the outer peripheral surface of the fixing roller 102, a rotational operation for reducing the temperature difference in a peripheral direction at the outer peripheral surface of the fixing roller 102, and an operation of causing the external heating roller (not shown) to contact the outer peripheral surface of the fixing roller 102.

The preparation operation of the fixing device 100 and the forced transporting operation of the recording paper P are performed not at the time of restoration from a temporary standby state after performing the image formation and the fixing on the recording paper P, but when the fixing device is reoperated after a user performs an erroneous operation (such as opening a cover or forcedly turning off a power supply) during transportation of the recording paper P in the image forming apparatus 10.

Figure 5A:
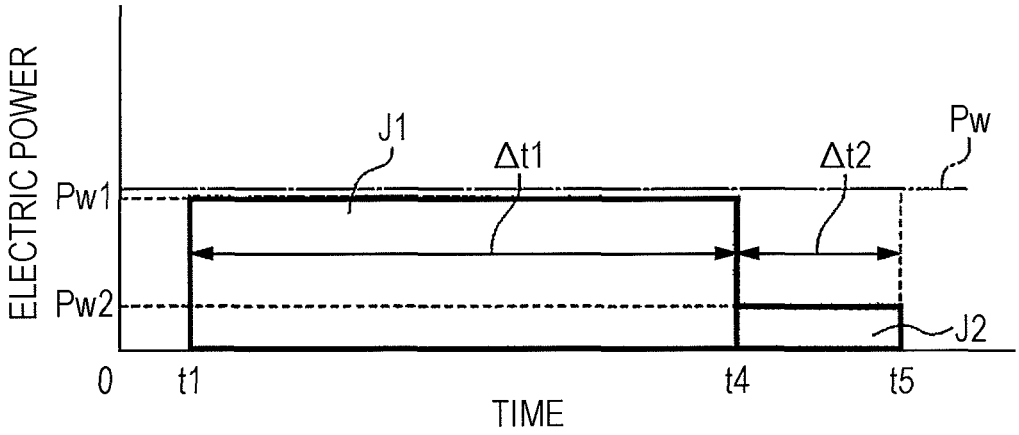
FIG. 5A is a graph illustrating operation time and power consumption when jamming of the recording paper is eliminated after increasing the temperature of the fixing device according to the exemplary embodiment of the present invention.

FIG. 5A shows a first example of the electric power for each operation and the order of each operation that is set by the controller 20 (see FIG. 1) in the preparation operation (J1) of the fixing device 100 (see FIG. 1) and the forced transporting operation (J2) of the recording paper P. In the first example, the forced transporting operation J2 of the recording paper P is set after ending the preparation operation J1 of the fixing device 100.

In FIG. 5A, a starting time of the preparation operation J1 of the fixing device 100 is t1, an ending time thereof is t4, an operation time from the starting time t1 to the ending time t4 is Δt1, and electric power used at each time from the starting time t1 to the ending time t4 is Pw1. The ending time t4 is the time when the temperature of the fixing roller 102 (see FIG. 1) detected by the temperature sensor (not shown) reaches a specified temperature. A starting time of the forced transporting operation J2 of the recording paper P is t4, an ending time thereof is t5, an operation time is Δt2, and electric power used at each time from the starting time t4 to the ending time t5 is Pw2. In FIG. 5A, a previously set specified value (upper limit) of electric power consumption of the image forming apparatus 10 (see FIG. 1) is Pw (indicated by an alternate long and short dash line). In the exemplary embodiment, Pw≅Pw1 (excluding when Pw<Pw1).

Figure 5B:
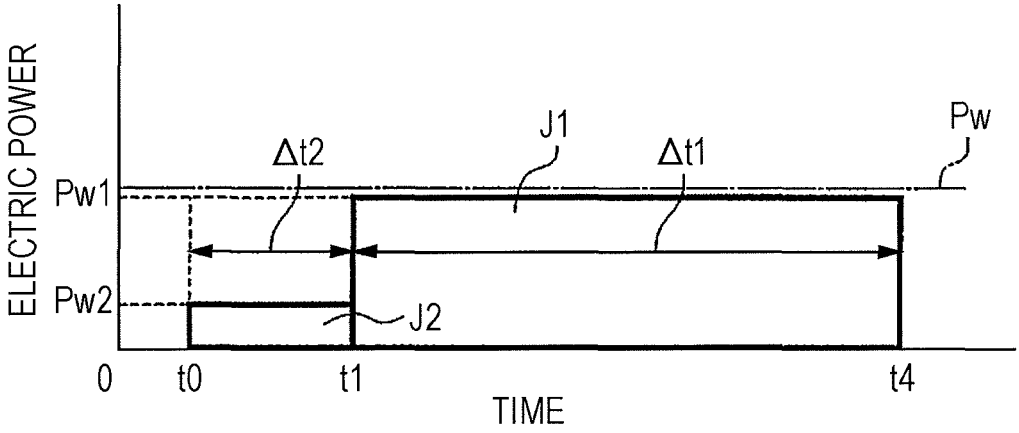
FIG. 5B is a graph illustrating operation time and power consumption when the jamming of the recording paper is eliminated before increasing the temperature of the fixing device according to the exemplary embodiment of the present invention.

FIG. 5B shows a second example of the electric power for each operation and the order of each operation that is set by the controller 20 (see FIG. 1) in the preparation operation (J1) of the fixing device 100 (see FIG. 1) and the forced transporting operation (J2) of the recording paper P. In the second example, the forced transporting operation J2 of the recording paper P is set before starting the preparation operation J1 of the fixing device 100. The starting time t1 and the ending time t4 of the preparation operation J1 of the fixing device 100 are unchanged. A starting time and an ending time of the forced transporting operation J2 of the recording paper P are t0 and t1, respectively.

Here, as shown in FIGS. 5A and 5B, the controller 20 (see FIG. 1) chooses and sets the forced transporting operation J2 of the recording paper P after ending or before starting the preparation operation J1 of the fixing device 100 in accordance with a position (jamming position) where the transportation of the recording paper P is stopped at each transport path of the image forming apparatus 10 shown in FIG. 4.

For example, in FIG. 4, when it is detected that sheets of recording paper P are jammed at the positions of the sheets of recording paper P1 and P2, toner images are not formed on the sheets of recording paper P. Therefore, as shown in FIG. 5A, the preparation operation J1 of the fixing device 100 is performed first, and, then, the forced transporting operation J2 of the recording paper P is carried out. In contrast, when it is detected that the sheets of recording paper P are jammed at the positions of the sheets of recording paper P3 and P4, fixed toner images are adhered to the sheets of recording paper P. Therefore, it is desirable to eliminate the jamming early. Accordingly, as shown in FIG. 5B, the forced transporting operation J2 of the recording paper P is performed before the preparation operation J1 of the fixing device 100.

Figure 6A:
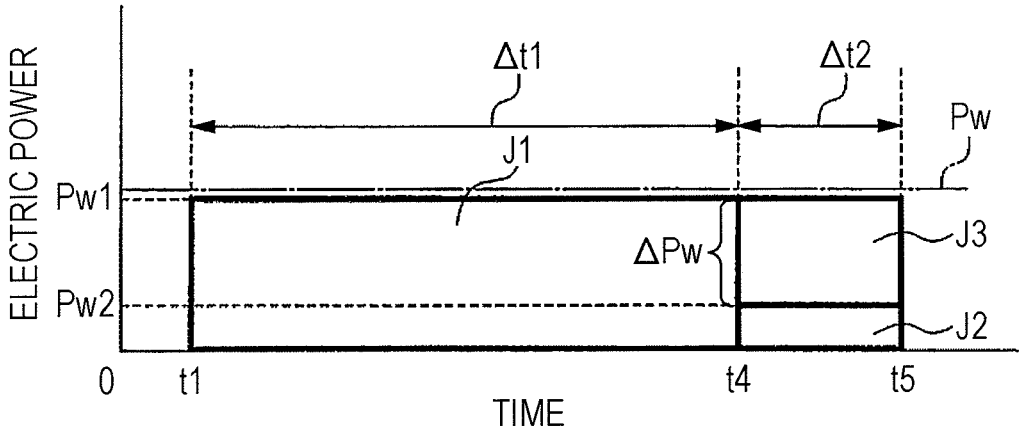
FIG. 6A is a graph illustrating operation time and power consumption when the elimination of the jamming of the recording paper and other operations are performed after increasing the temperature of the fixing device according to the exemplary embodiment of the present invention.
Figure 6B:
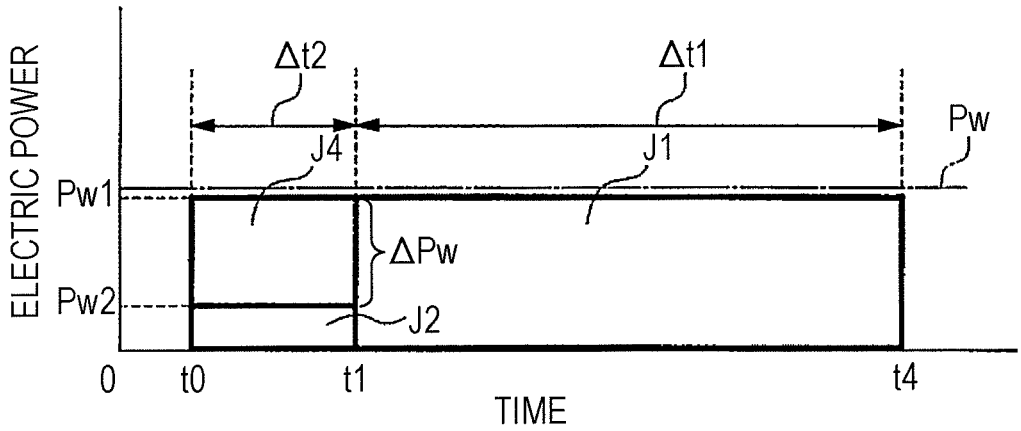
FIG. 6B is a graph illustrating operation time and power consumption when the elimination of the jamming of the recording paper and other operations are performed before increasing the temperature of the fixing device according to the exemplary embodiment of the present invention.

FIGS. 6A and 6B show a setting in which the forced transporting operation J2 of the recording paper P and an operation J3 are performed in parallel in the first example shown in FIG. 5A and a setting in which the forced transporting operation J2 of the recording paper P and an operation J4 are performed in parallel in the second example shown in FIG. 5B. Here, the operations J3 and J4 refer to operations that use electric power □Pw that exceeds the difference between the specified value Pw of electric power consumption and the electric power Pw1 for the preparation operation of the fixing device 100 (that is, Pw−Pw1). The operation J3 is performed after the preparation operation of the fixing device 100. The operation J4 is performed before the preparation operation of the fixing device 100.

Examples of the operation J3 include a rotational operation of the developing device 70 to a home position (see FIG. 2), an operation of reading information in a memory provided in a unit that a user using, for example, the toner cartridges 78 (see FIG. 1) replaces, an operation of moving the intermediate transfer belt 68 to a home position, and an operation of retracting the second transfer roller 71 (that is, a contacting operation or a retracting operation performed with respect to the intermediate transfer belt 68).

Examples of the operation J4 are an exhaust operation of an exhaust fan (not shown) provided at the apparatus body 10A (see FIG. 1) of the image forming apparatus 10, an operation of confirming a state of transfer in which a test image is transferred to the intermediate transfer belt 68, and an operation of discharging waste toner (unnecessary toner) in, for example, the cleaning device 73.

Next, operation settings and operation of an image forming apparatus 10 in a comparative example will be described.

Figure 7A:
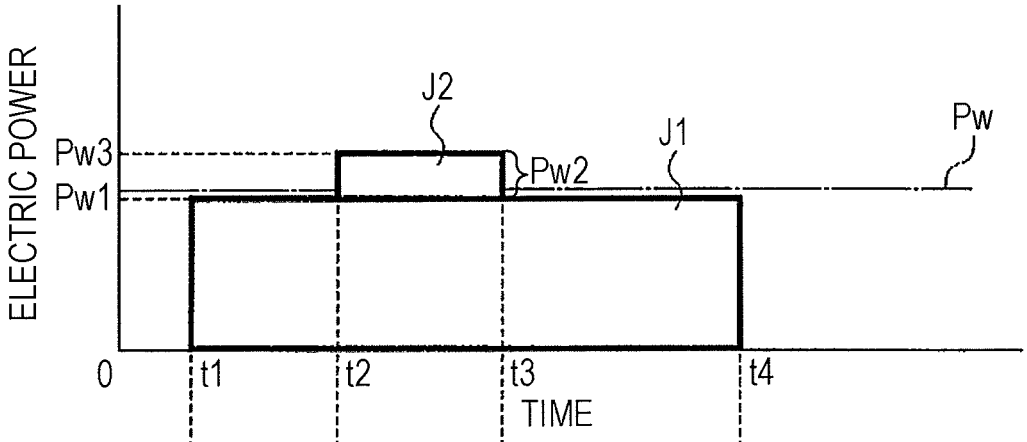
FIG. 7A is a graph illustrating operation time and power consumption when the increasing of the temperature of the fixing device and the elimination of the jamming of the recording paper are performed at the same time, and the power consumption exceeds a prescribed value in a comparative example.

As shown in FIG. 7A, even if an attempt is made to perform in parallel the preparation operation J1 of the fixing device 100 (see FIG. 1) and the forced transporting operation J2 of the recording paper P in a period from the time t2 to the time t3 (which is set between the time t1 and the time t4), an electric-power total Pw3=(Pw1+Pw2) of the electric powers thereof exceeds Pw, as a result of which it is not possible to perform the operations J1 and J2 in parallel.

Figure 7B:
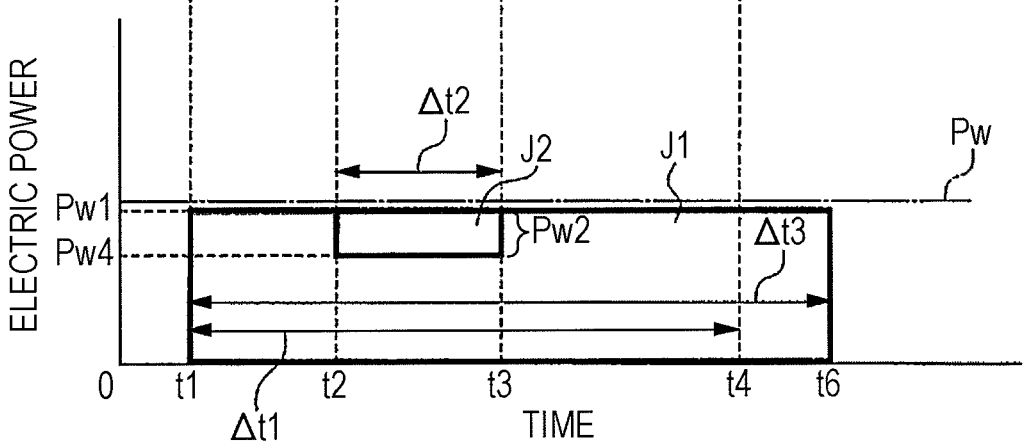
FIG. 7B is a graph illustrating operation time and power consumption when the increasing of the temperature of the fixing device and the elimination of the jamming of the recording paper are performed at the same time in a range in which the prescribed value of the power consumption is not exceeded in the comparative example shown in FIG. 7A.

Here, as shown in FIG. 7B, in the comparative example, in the period from the time t2 to the time t3, a setting in which an amount of electric power that is applied to the halogen heater 108 (see FIG. 3) is reduced or a setting in which the pressure roller 104 is brought into contact with the outer peripheral surface of the fixing roller 102 after the time t3 is performed. The setting is performed to reduce the amount of electric power used in the preparation operation J1 of the fixing device 100 in the period from the time t2 to the time t3, to perform the forced transporting operation J2 of the recording paper P in parallel in accordance with the reduced amount of electric power.

At this time, since the electric power applied to the halogen heater 108 is reduced from Pw1 to Pw4=(Pw1−Pw2) in the period from the time t2 to the time t3, the rate of increase of the temperature of the fixing roller 102 per unit time is reduced. Therefore, the time required for the preparation operation J1 of the fixing device 100 (see FIG. 1) is longer than the time □t1 from the time t1 to the time t4, as a result of which a time □t3 from the time t1 to a time t6 is required. That is, it is no longer possible to reduce the time taken for the preparation operation J1 of the fixing device 100.

Next, the operation of the exemplary embodiment will be described.

In the image forming apparatus 10 according to the exemplary embodiment, as shown in FIGS. 5A and 5B, the forced transporting operation J2 of the recording paper P is set after ending or before starting the preparation operation J1 of the fixing device 100. Therefore, it is no longer necessary to reduce the amount of electric power applied to the halogen heater 108 (see FIG. 3) of the fixing device 100. This causes the time taken for the preparation operation J1 of the fixing device 100 to be less than that in the comparative example while maintaining the rate of increase of the temperature of the fixing roller 100 per unit time and without exceeding the specified value Pw of the electric power consumption. In the preparation operation J1 of the fixing device 100, the heating operation of the fixing roller 102 has its rate limited. Therefore, preparation time of the entire image forming apparatus 10 according to the exemplary embodiment in which the time taken for the preparation operation J1 of the fixing device 100 is reduced is shorter than that according to the comparative example.

In the image forming apparatus 10 according to the exemplary embodiment, as shown in FIGS. 6A and 6B, the operations J3 and J4 that consume electric power exceeding the difference between the electric-power specified value Pw and the electric power Pw1 are performed at the time when the forced transporting operation J2 of the recording paper P is performed. Therefore, the preparation time of the entire image forming apparatus 10 including the preparation operation J1 of the fixing device 100 and the forced transporting operation J2 of the recording paper P is less than the preparation time when the operations J3 and J4 are performed at other times.

Further, in the image forming apparatus 10 according to the exemplary embodiment, in FIG. 4, the forced transporting operation J2 of the recording paper P is chosen and performed before starting or after ending the preparation operation J1 of the fixing device 100 in accordance with where the sheets of recording paper P1, P2, P3, and P4 stop. Therefore, compared to when the forced transporting operation J2 of the recording paper P is performed both before starting and after ending the preparation operation J1 of the fixing device 100, the preparation time of the entire image forming apparatus 10 is reduced.

The present invention is not limited to the above-described exemplary embodiment.

The fixing roller 102 may be a fixing belt that is heated by an electromagnetic induction method. In addition, the drawing out unit 170 need not be provided. For example, a structure that is not provided with the drawing out unit 170 may be one that brings the recording paper P out of a state in which it is stopped so as to exist in both the sheet holding unit 12 and the body 14.

Further, the time when the forced transporting operation of the recording paper P is performed may be fixed to either the time before starting or the time after ending the preparation operation of the fixing device 100 instead of being chosen therefrom. That is, a structure in which the forced transporting operation of the recording paper P is performed after ending the preparation operation of the fixing device 100 may be used. Still further, there may be used a structure in which a sheet sensor detects whether or not any sheets of recording paper P remain in the transport paths before starting the preparation operation of the fixing device 100, and in which, if there are any sheets, the preparation operation of the fixing device 100 is started after performing the forced transporting operation of the recording paper P.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transporting section including a transport path for transporting a recording medium;

an image forming unit that forms an image on the recording medium that is transported at the transporting section;

a fixing device that fixes the image formed on the recording medium at the image forming unit while heating the image formed on the recording medium; and a controller that controls the transporting section to perform a forced transporting operation, which forcedly transports the recording medium jammed in the transporting section before starting or after ending an operation of increasing a temperature of the fixing device in accordance with where the transporting of the recording medium is stopped in the transport path.

2. The image forming apparatus according to claim 1, wherein the controller chooses either performing of the forced transporting operation of the recording medium by the transporting section before starting the preparation operation of the fixing device or performing of the forced transporting operation of the recording medium by the transporting section after ending the preparation operation of the fixing device in accordance with where the transporting of the recording medium is stopped in the transport path.

3. The image forming apparatus according to claim 1, wherein the controller controls the transporting section based on whether the recording medium includes the fixed formed image.

4. The image forming apparatus according to claim 3, wherein if the recording medium includes the fixed formed image, the forced transporting operation of the transporting section is performed before starting the operation of increasing a temperature of the fixing device and if not, the forced transporting operation of the transporting section is performed after the ending of the operation of increasing a temperature of the fixing device.

5. The image forming apparatus according to claim 1, wherein the controller performs controls so that Pw<Pw1+Pw2 is set, wherein Pw1 is electric power for the preparation operation including increasing a temperature of the fixing device, Pw2 is electric power for the forced transporting operation of forcedly transporting the recording medium that is jammed in the transporting section, and Pw is a specified value of electric power consumption.

6. The image forming apparatus according to claim 5, wherein the specified value of electric power consumption is an upper limit value of electric power consumption of the image forming apparatus.

7. The image forming apparatus according to claim 5, wherein an operation using electric power that exceeds a difference between the specified value Pw and the electric power Pw1 is performed in parallel with the forced transporting operation of the transporting section.

8. A method of maintaining a specified value of electrical power consumption of an image forming apparatus, the method comprising:

providing the image forming apparatus comprising:

a transporting section including a transport path for transporting a recording medium;

an image forming unit that forms an image on the recording medium that is transported at the transporting section;

a fixing device that fixes the image formed on the recording medium at the image forming unit while heating the image formed on the recording medium; and a controller; and controlling the transporting section to perform a forced transporting operation, which forcedly transports the recording medium jammed in the transporting section before starting or after ending an operation of increasing a temperature of the fixing device in accordance with where the transporting of the recording medium is stopped in the transport path.

9. The method according to claim 8, wherein the controller chooses either performing of the forced transporting operation before starting the preparation operation of the fixing device or after ending the preparation operation of the fixing device in accordance with where the transporting of the recording medium is stopped in the transport path.

10. The method according to claim 8, wherein the controller controls the transporting section based on whether the recording medium includes the fixed formed image.

11. The method according to claim 10, wherein controlling the transporting section to perform the forced transporting operation before starting the operation of increasing a temperature of the fixing device if the recording medium includes the fixed formed image, and controlling the transporting section to perform the forced transporting operation after the ending of the operation of increasing a temperature of the fixing device if the recording medium does not include fixed formed image.

12. The method according to claim 8 further comprising performing controls so that Pw<Pw1+Pw2 is set, wherein Pw1 is electric power for the preparation operation including increasing a temperature of the fixing device, Pw2 is electric power for the forced transporting operation of forcedly transporting the recording medium that is jammed in the transporting section, and Pw is a specified value of electric power consumption.

13. The method according to claim 12, wherein the specified value of electric power consumption is an upper limit value of electric power consumption of the image forming apparatus.

14. The method according to claim 12, wherein an operation using electric power that exceeds difference between the specified value Pw and the electric power Pw1 is performed in parallel with the forced transporting operation of the transporting section.

* * * * *